US007866676B2

(12) United States Patent
Gallay et al.

(10) Patent No.: US 7,866,676 B2
(45) Date of Patent: Jan. 11, 2011

(54) DEVICE FOR RETAINING A BOOT ON A SNOWSHOE

(75) Inventors: Philippe Gallay, La Clusaz (FR); Julie Mallinjoud, Annecy le Vieux (FR); Bruno Deloustal, Annecy (FR)

(73) Assignee: TSL Sport Equipment, Alex (FR)

( * ) Notice: Subject to any disclaimer, the term of this patent is extended or adjusted under 35 U.S.C. 154(b) by 348 days.

(21) Appl. No.: 12/009,678

(22) Filed: Jan. 22, 2008

(65) Prior Publication Data

US 2008/0211205 A1 Sep. 4, 2008

(30) Foreign Application Priority Data

Jan. 24, 2007 (FR) ..... 07 00481

(51) Int. Cl.
*A63C 1/18* (2006.01)

(52) U.S. Cl. ..... 280/11.3; 280/11.16

(58) Field of Classification Search ..... 280/11.3, 280/11.31, 11.33, 611, 614, 615, 617, 11.16; 36/116, 122, 124, 125
See application file for complete search history.

(56) References Cited

U.S. PATENT DOCUMENTS

| | | | | |
|---|---|---|---|---|
| 1,523,222 | A * | 1/1925 | Leet | 36/125 |
| 3,638,333 | A * | 2/1972 | Sprandel | 36/125 |
| 5,493,794 | A * | 2/1996 | McKenzie et al. | 36/122 |
| 5,970,632 | A | 10/1999 | Watson | 36/122 |
| 2004/0250453 | A1 * | 12/2004 | Settelmayer | 36/122 |
| 2007/0163151 | A1 * | 7/2007 | Monsees et al. | 36/122 |

FOREIGN PATENT DOCUMENTS

| | | |
|---|---|---|
| EP | 0 681 855 | 11/1995 |
| FR | 2 770 144 | 4/1999 |
| WO | WO 2007/084580 | 7/2007 |

* cited by examiner

*Primary Examiner*—J. Allen Shriver, II
*Assistant Examiner*—Bryan A Evans
(74) *Attorney, Agent, or Firm*—Fay Sharpe LLP

(57) ABSTRACT

A device for laterally retaining a boot on a snowshoe (1), comprises a retaining plate (3) with a plane of general symmetry (P), on which are mounted front retaining means (4) made up of an assembly of retaining walls (4*a*, 4*b*) forming an enclosure in which the front and/or rear end of the boot is to be engaged. The device includes an adjustment structure for adjusting the distance between the two lateral retaining walls (4*a*, 4*b*), that is between a left wall (4*a*) and a right wall (4*b*).

6 Claims, 3 Drawing Sheets

DEVICE FOR RETAINING A BOOT ON A SNOWSHOE

BACKGROUND

The present invention concerns a device for retaining a boot on a snowshoe and more particularly the retention of the front of the latter. The invention concerns also the snowshoe equipped with the device.

The snowshoes, devices known for very many years, have been used for several centuries by the Scandinavian populations to move on snow. Until recently, snowshoes were used by ordinary travelers or soldiers to allow the populations and the alpine troops to move on snow for the movements required by everyday life. Currently, snowshoes are instead used by walkers or sportsmen who undertake outings and walks, and even competitions.

There already exist devices of different types for retaining the boot on the snowshoe. There are known more particularly two types, those called a plate and those called a boot envelope. Generally, the devices of the plate type are more often used by the sportsmen mindful of performance because retention of the foot is assured with more rigidity. The devices of the boot envelope type are made of a front fitting defined by a rubber envelope, or by straps by which the extreme front end of the boot is retained. But, if this latter type of fitting is more preferred by the walkers who are not as demanding as sportsmen who are mindful of performance, it is less so for walkers who also want a good lateral hold of their boot.

SUMMARY

The present invention proposes to resolve the drawbacks of these known devices and proposes a device permitting better lateral adjustment and better hold of the foot which is simple, convenient, secure and reliable, and whatever type of binding are utilized.

Also, the lateral retaining device for a boot on a snowshoe, according to the invention, is constituted by a retaining plate with a plane of general symmetry, on which are mounted front retaining means constituted by an assembly of retaining walls forming and enclosure in which the extreme front of the boot and/or the rear of the boot is intended to be engaged, and is characterized in that the device includes means for adjusting the distance between the two lateral retaining walls, that is between the left wall and a right wall.

According to a supplemental characteristic, at least one of the lateral walls includes lateral channel means for guiding the plate and for locking it in the chosen lateral position.

According to another characteristic, the sliding means are made up of a sliding element integral with the lateral wall which cooperates with a sliding channel defined in the plate, of corresponding shape that extends transversely with respect to the plane of general symmetry.

Let us add that the locking means made up of a movable lock mounted for upward movement on the plate cooperates with a set of teeth made up of a set of hollow shapes defined on the sliding element.

According to another supplementary characteristic, the enclosure is defined by two lateral retaining walls, that is a left wall and a right wall, made of a flexible plastic material.

According to the preferred embodiment, the enclosure is open towards the rear to receive the front end of the boot, such that each of the lateral walls includes a front wall portion which extends substantially vertically such that its upper end is extended from the front portion, extending on a bias towards the front at which its front end is attached to the front of the plate.

Note also that in the preferred embodiment, the lateral wall portion of one of the lateral retaining walls is extended above a portion of the notched strap that is configured to cooperate with the locking means disposed on the other lateral wall portion, said means being made up of an adjustment buckle with a pivoting pawl, this later cooperates by engaging with the succession of locking teeth, permitting the volume of the enclosure and particularly its periphery to be adjusted, and also to assure a good grip on the front of the boot.

Other characteristics and advantages of the invention will become apparent from the description which will follow in combination with the attached drawings which are given by way of non-limiting example.

BRIEF DESCRIPTION OF THE DRAWINGS

FIGS. 2 and 3 are views in which two widths are adjusted with lateral symmetry.

FIG. 4 is a view illustrating an asymmetric lateral adjustment.

DETAILED DESCRIPTION

Figure 1:
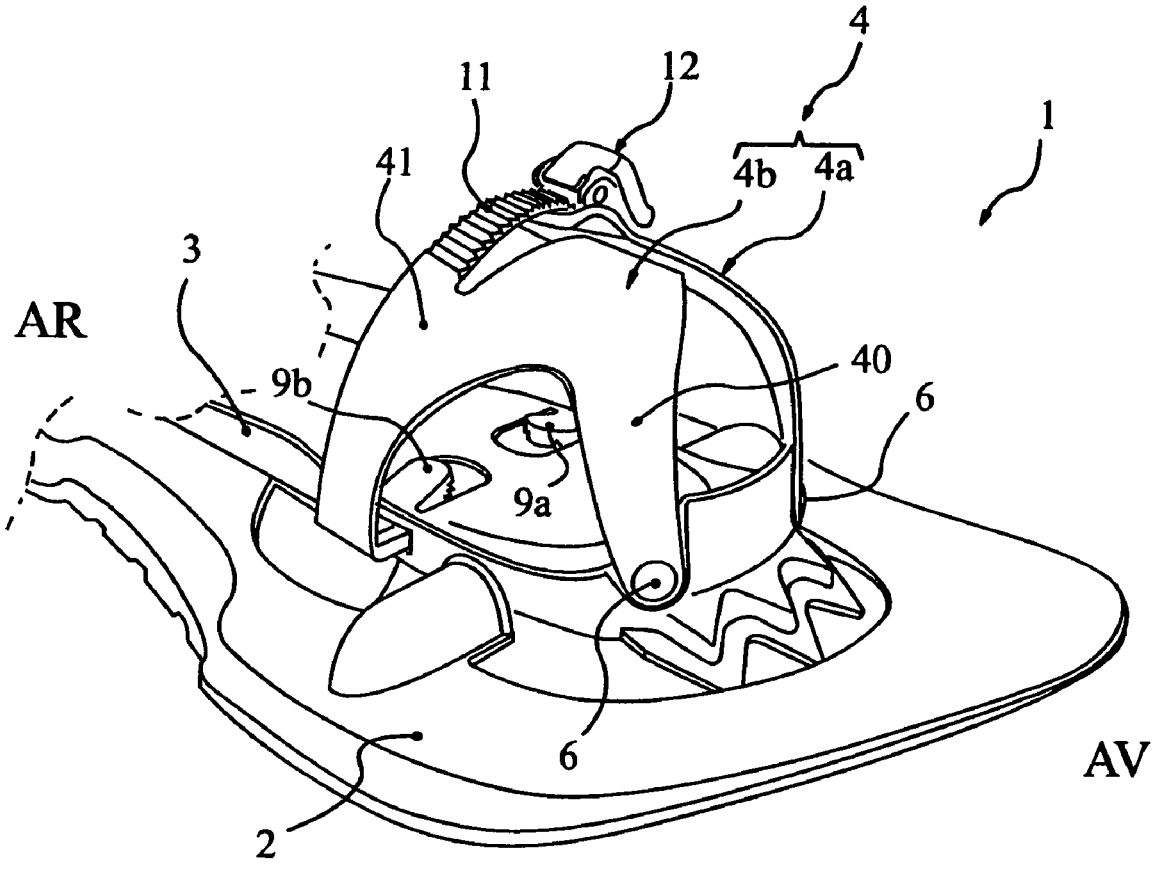
FIG. 1 is a front perspective view of retaining device.

The snowshoe is designated by the general reference 1 takes the form of a plate adjoining a plane of general symmetry P on which is attached the boot of the user and which is composed of a deck 2, including an assembly of walls supporting the binding 3 intended to retain the boot of the user.

The snowshoe 1 intended to be equipped with the device of the present invention, of course, can be of any type. It can, for example, be of the type which the deck 2 for example is plastic material, or the type including a peripheral frame retaining a fabric.

Note that the binding 3 intended to retain the boot is, according to the illustration given by way of example, pivotally connected to the deck 2 of the snowshoe itself, along a transverse axis XX', in order to allow the user to raise his heel while moving forward.

Said binding carrying the general reference 3 is constituted by a pivotal plate including a retaining means for the boot, including a front means 4 and a rear means (not shown).

The front retaining means 4 are intended to retain the front of the boot on the pivotal plate 3. These means are advantageously constructed of semi-rigid elements. Of course, the embodiment is illustrated with a plate extending the length of the sole of the boot, but it can be otherwise such as for example not expending beyond the front of the sole. In this description and in the claims, the term plate of course covers a binding of which the plate can extend the full length of the sole of the boot, but also a plate that does not extend beyond the front of the sole.

Also, the front end of the boot is retained on the snowshoe during forward motion by the device according to the invention carrying the general reference 4, and which is constituted by an assembly of flexible retaining walls 4*a*, 4*a* forming an enclosure 5 or cavity opening towards the rear in which the front end of the boot (not shown) is engaged and retained.

According to the represented embodiment of the device, the enclosure 5 or cavity opening towards the rear AR is composed of two lateral retaining walls 4*a*, 4*b*, known as a left wall 4*a* and a right wall 4*b*. The assembly of walls is made for example of a deformable plastic material.

Each of the lateral walls 4*a*, 4*b* includes a front wall portion 40 and can comprise a portion of lateral wall 41.

The portion of the lateral wall 41 extends substantially vertically and its upper end is extended according to the embodiment given by way of example, by the front portion 40, extending skewed towards the front. The front wall portion 40 is attached by its front end to the front of the plate 3 for example by a rivet 6 or any other means.

According to the invention, the lateral portions 41 of the lateral retaining walls 4*a*, 4*b* are intended to be brought together with the boot thanks to a bringing together and removal means. The bringing together of the walls is carried out until these are in contact with the boot in order to insure its retention.

To this effect, the lower part of each portion of the lateral walls 41 is extended by a lower horizontal thin plate 42 extending towards the plane of symmetry P.

Each of the thin horizontal plates is a slide element 42 intended to cooperate with the slide channel 7 of corresponding form defined in the front of the plate. The slide channel extends advantageously perpendicular to the plane P.

In addition the upper surface of the slide element 42 includes a set of teeth 8 made up of a succession of hollow locking shapes.

Note that the plate includes at the level of the slide channel two movable locking elements 9 intended to cooperate with the set of teeth 8 of the slide elements 42.

Each of the movable locking elements 9 is movable upward by elastic deformation to be able to take on two positions, particularly a lower active locking position and an upper inactive unlocking position. Note that the lock includes at least one locking tooth 10 configured to cooperate with at least one of the hollow locking shapes when the lock if in the active locking position.

It will be understood that the lock or locks 9 with its cooperation with the set of teeth 8 constitutes the locking means of the front retaining means 4 once their lateral position is selected.

Let us add that the portion of the lateral wall 41 of one of the lateral retaining walls is extended on the top by a notched strap portion 11 configured to cooperate with locking means disposed on the other lateral wall portion. Of course, any other device can be utilized without departing from the framework of the invention, like for example a system of a strap cooperating with a buckle.

These means are for example such as those illustrated constituted by an adjustment buckle 12 with a pivotal pawl 13. This latter cooperates by selectively engaging with the succession of teeth 11 of the lock permitting the volume of the enclosure 5 and particularly its periphery to be adjusted and also assures a good hold on the front of the boot.

Specifically, the front retaining means 4 constituted by the lateral retaining walls 4*a*, 4*b* are movably mounted for transverse displacement relative to the pivot plate 3 in order to be brought together and moved apart such that their outer distance is adapted to the morphology of the boot at the level of its lateral front retention.

Let us add that the plate is advantageously made of a plastic material and the two locks 9 are injection molded with the assembly of the plate. Also the upward pivoting of the lock is made against the contrary force from the memory of the plastic, and returns automatically to their lower active locking position.

Note also that the locks 9 are disposed to the front of the pivoting plate 3 and are found in the zone occupies by the sole of the boot. Also the sole of the boot, resting on the locks, prevents any inopportune unlocking.

Figure 2:
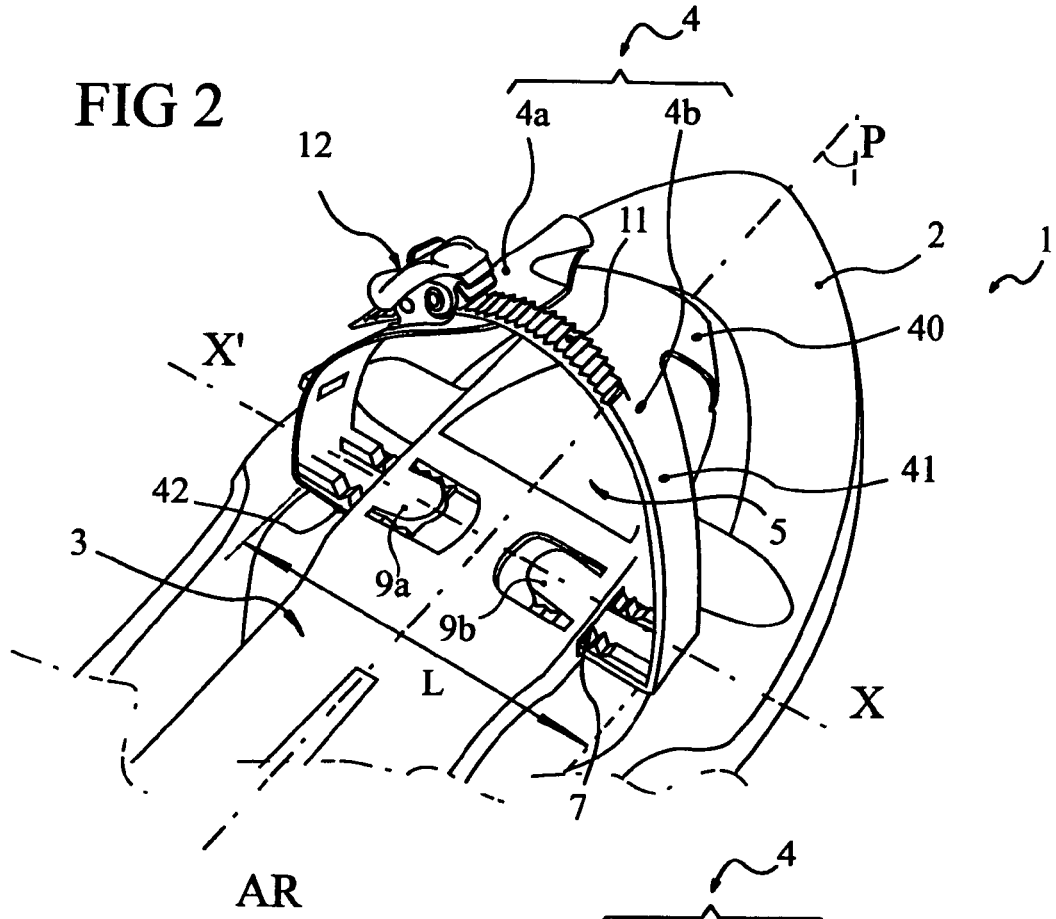
FIGS. 2, 3, 4 are rear perspective views of the retaining device adjusted to three different widths.
Figure 3:
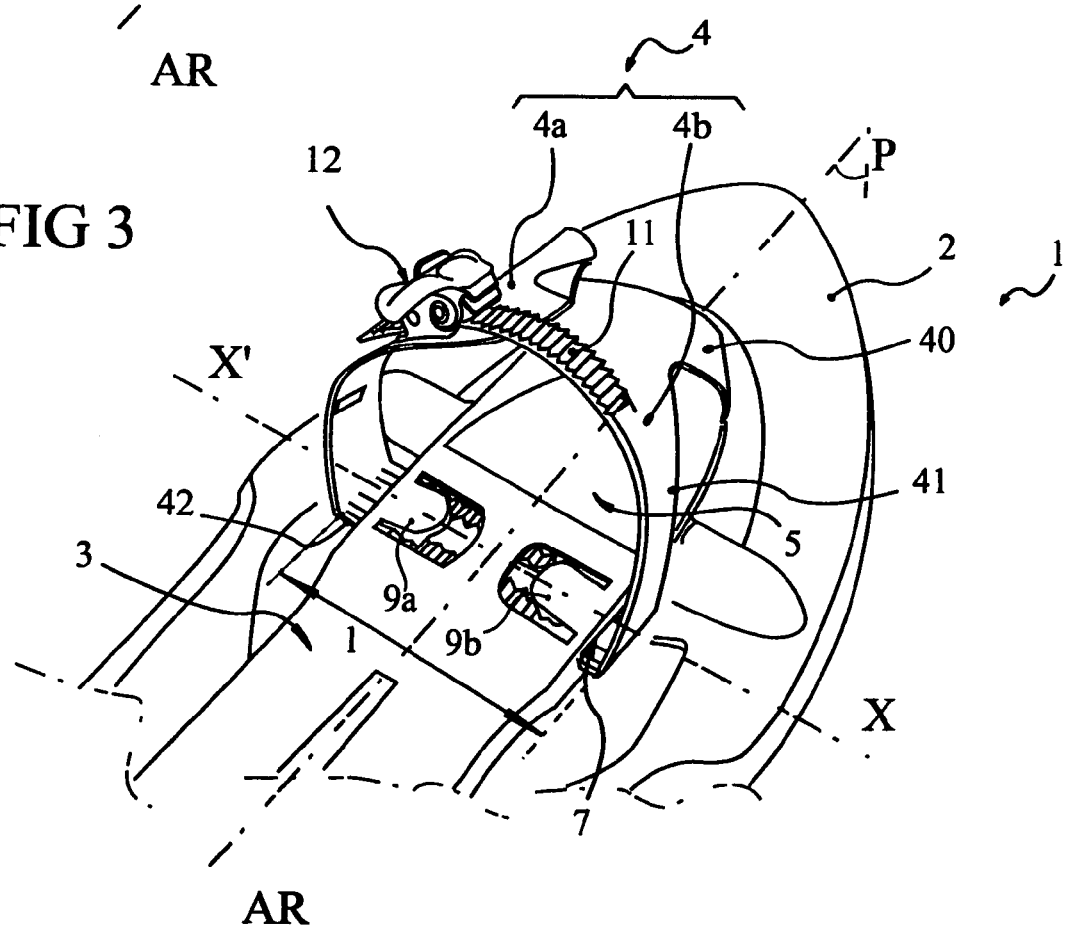
Figure 4:
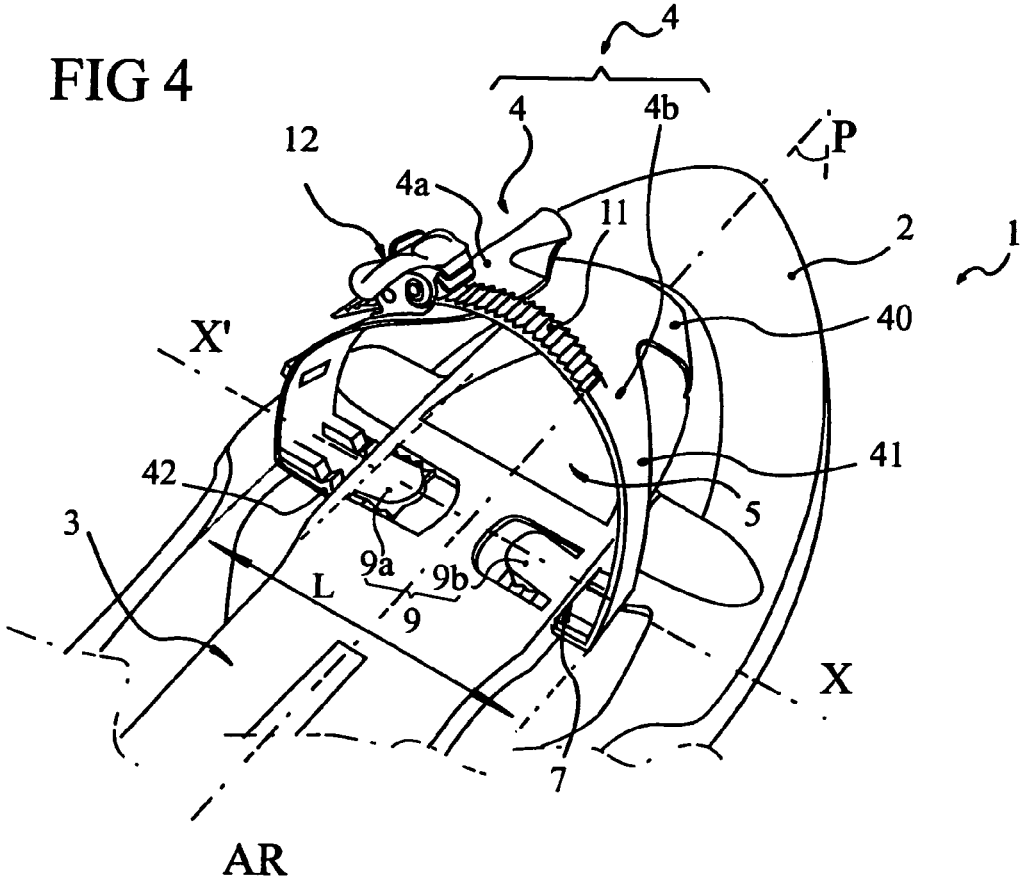
Figure 5:
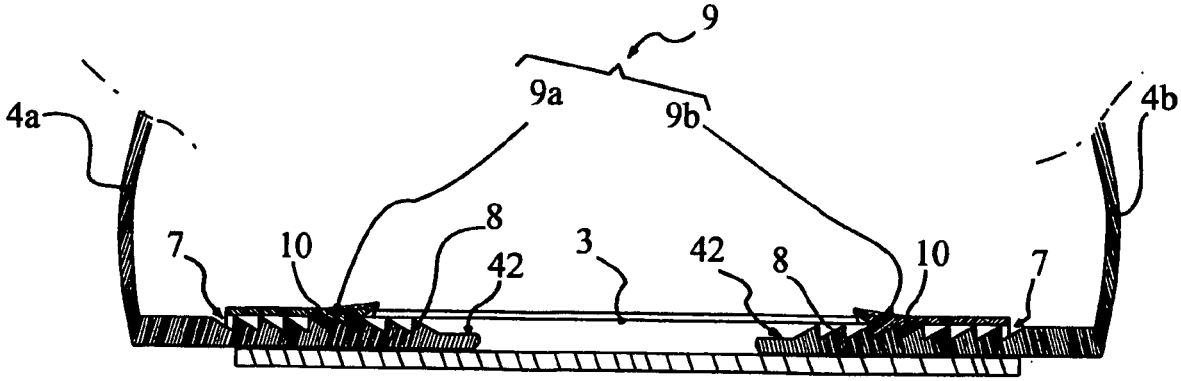
FIG. 5 is a transverse sectional view at the level of the slide channel.

FIGS. 2, 3, 4 are rear perspective views of the retaining device according to three different adjustments in width.

FIG. 2 is a view illustrating a symmetric lateral adjusted width, in which the distance between the two lateral walls, known as the right and left is of the large dimension L.

FIG. 3 is a view illustrating an asymmetric laterally adjusted width, in which the distance between the two lateral walls, known as the right and left is of the lesser dimension l.

FIG. 4 is a view illustrating an asymmetric laterally adjusted width, according to which the left lateral wall is more removed from the plane of symmetry than is the right wall.

According to the embodiment given by way of example and illustrated by the figures, there are two lateral retaining walls which are adjustable in lateral position, known as the left lateral wall 4*a* and the right lateral wall 4*b* but it can be otherwise. Also, only one of the lateral walls can be adjustable in lateral position.

Of course, the invention is not limited to the embodiments described and represented by the examples but it includes all equivalent techniques and their combinations.

Also, the device of the invention given in the example is illustrated and described in the case of the retainer for the front of the boot can also be used to retain laterally the rear of the boot and particularly the heel.

The invention has been described with reference to the preferred embodiments. Modifications and alterations may occur to others upon reading and understanding the preceding detailed description. It is intended that the invention be construed as including all such modifications and alterations insofar as they come within the scope of the appended claims or the equivalents thereof.

The invention claimed is:

1. A device for laterally retaining a boot on a snowshoe, comprising:

a retaining plate with a plane of general symmetry on which are mounted front retaining means comprising an assembly of retaining walls forming an enclosure in which a front and/or rear end of the boot is to be engaged;

a means for adjusting a distance between the two lateral retaining walls, each of the lateral walls including a means for laterally sliding on the retaining plate, and for locking in a selected lateral position, and in which the sliding means are made up of a sliding element integral with the lateral wall that cooperates with a slide channel of corresponding shape that extends transversely with respect to the plane of general symmetry, and wherein the lower part of each of the lateral walls is extended by a lower horizontal tab that extends towards the plane of general symmetry, to define the sliding element configured to cooperate with the slide channel of corresponding shape defined in the front of the plate, and wherein, the locking means are made up of a movable lock mounted for upward movement on the plate and cooperating with a set of teeth made up of a succession of hollow shapes defined on the sliding element.

2. The device for laterally retaining a boot on a snowshoe according to claim 1, wherein the enclosure is composed of a left wall and a right wall made of a flexible plastic material.

3. The device for laterally retaining a boot on a snowshoe according to claim 1, wherein each of the lateral walls includes a front wall portion that extends substantially vertically such that its upper end is extended by the front portion, for extending skewed toward the front such that its front end is attached to the front of the plate.

4. The device for laterally retaining a boot on a snowshoe according to claim 1, wherein the lateral wall portion of one of the lateral retaining walls is extended downward by a notched strap configured to cooperate with locking means disposed on the other lateral wall portion, said means being made up of an adjustment buckle with a pivotal pawl, this later cooperating in increments with a succession of locking teeth, permitting adjustment of the volume of the enclosure and particularly its periphery, and also to assure a good hold on the front of the boot.

5. A device for retaining a boot on a snowshoe comprising:

a retaining plate pivotally mounted to a deck of the snowshoe, the retaining plate defining a transverse channel and defining at least a first locking element disposed above the channel with a locking pawl extending into the channel;

a boot retaining structure including at least left and right retaining walls which extend around left and right sides of the boot and connect with the retaining plate, the left and right side retaining walls including a slide elements which are slidably received in the transverse channel, the slide element including a series of teeth which engage the locking pawl for adjustably fixing a distance between the left and right retaining walls, and wherein the retaining plate includes a second locking element with a locking pawl extending downward into the transverse channel and both the left and right retaining walls include slide elements that are slidably received in the transverse channel, both of slide elements having a series of the upward extending teeth which engage a corresponding locking pawl.

6. A device for laterally retaining a boot on a snowshoe, comprising:

a retaining plate with a plane of general symmetry on which are mounted an assembly of retaining walls forming an enclosure in which a front and/or rear end of the boot is to be engaged;

two lateral walls extending upward from the retaining plate to engage sides of the boot;

two lower horizontal tabs each extending from and integral with a lower part of a corresponding of the two lateral walls, the tabs extending towards the plane of general symmetry to define sliding elements configured to cooperate with a slide channel of corresponding shape defined in a front of the retaining plate and extending transversely with respect to the plane of general symmetry, the sliding elements sliding in the slide channel to adjust a distance between the two lateral retaining walls;

a set of teeth made up of a succession of hollow shapes defined on each of the sliding elements; and a movable lock mounted on the retaining plate for vertical movement to cooperate with the sets of teeth to lock the two lateral walls in selected lateral positions.

* * * * *